US005575697A

United States Patent [19]

Kaedei

[11] Patent Number: 5,575,697

[45] Date of Patent: Nov. 19, 1996

[54] CONNECTION DEVICE

[76] Inventor: Keiko Kaedei, 64, Midorigaoka 4-chome, Yao-shi, Osaka, Japan

[21] Appl. No.: 302,986

[22] Filed: Sep. 12, 1994

[30] Foreign Application Priority Data

Mar. 2, 1994 [JP] Japan ..... 6-032250

[51] Int. Cl.[6] ..... H01R 11/11

[52] U.S. Cl. ..... 439/883; 439/868

[58] Field of Search ..... 439/868, 883, 439/858, 433, 434

[56] References Cited

U.S. PATENT DOCUMENTS 1,845,273 3/1932 Hosking ..... 439/883
3,861,780 1/1975 Hobbs, II ..... 439/883

FOREIGN PATENT DOCUMENTS 2183404 6/1987 United Kingdom ..... 439/883

OTHER PUBLICATIONS

IBM Technical Disclosure Bulletin Jul. 1970, "Split End Wire Terminal" p. 383.

*Primary Examiner*—David L. Pirlot
*Attorney, Agent, or Firm*—Wenderoth, Lind & Ponack

[57] ABSTRACT

A connection device is provided for use in connecting a first member to a second member. The connection device includes a first member connection portion, and a second member connection portion integrally formed with the first member connection portion. The first member connection portion includes a base portion connected to the second member connection portion, and first and second arm portions extending in a direction away from the base portion and the second member connection portion. The first and second arm portions are curved outwardly from one another so as to define therebetween a first member receiving hole, and the first and second arm portions have first and second tip portions, respectively, at distal ends thereof, and a first member insertion slit is defined between the tip end portions and extends outwardly from the first member receiving hole. Further, the first and second arms are curvilinearly bent so as to be respectively non-planar, and the first member insertion slit is of a width substantially equal to a diameter of the first member receiving hole. With this arrangement, the first member connection portion functions to receive a shaft portion of a first member by allowing the shaft portion to pass through the first member insertion slit, and to subsequently, upon deformation of the first member connection portion into a substantially planar shape, trap the shaft portion in the first member receiving hole in such a manner that the shaft portion cannot pass out of the first member receiving hole through the first member insertion slit.

26 Claims, 4 Drawing Sheets

Prior Art Fig.11a

Prior Art Fig.11b

Prior Art Fig.11c

CONNECTION DEVICE

BACKGROUND OF THE INVENTION

The present invention relates to a connection device that can be easily and quickly connected to an object, but is not easily disengaged from the object once secured thereto. More particularly, in one embodiment, the present invention relates to a connection device for quickly but securely connecting an electrical cable to an electrical terminal.

Normally, a conventional connection device such as a terminal is secured to a tapped base (i.e. a base having a threaded hole, and a bolt or a screw screwed into the threaded hole). There are many cases in which the secure connection of the terminal is very important. For example, if high voltage is supplied to the terminal or a substantial amount of current flows through the terminal, poor contact or disconnection of the terminal from the tapped base can lead to a disastrous accident. Poor contact or disconnection of the terminal can also result in the shut-down of working facilities, thereby adversely affecting operating efficiency. To prevent this, a variety of terminals have been proposed which will generally prevent unintentional disconnection of a terminal from its tapped base.

Examples of prior art terminals are shown in FIGS. 11*a*–11*c*. An O-shaped terminal 13 as shown in FIG. 11*a* and a U-shaped terminal 14 as shown in FIG. 11*b* are widely used today.

The U-shaped terminal of FIG. 11*b* can be easily engaged with and disengaged from the tapped base by merely loosening a fastened bolt, thus providing high workability.

However, in the event that the fixing bolt is slightly loose because it was not securely tightened or because it has loosened due to vibrations or the like, the U-shaped terminal 14 is apt to be undesirably disconnected from the tapped base. This is especially true when there is a tractive force acting on a cable attached to the terminal. Although unexpected disconnection of a U-shaped terminal from a tapped base can be prevented to some extent by providing the terminal with bent tip portions as shown for terminal 15 in FIG. 11*c*, this method has proven to be still ineffective to fully solve the problem of disconnection.

This unintentional disconnection of a terminal can be prevented by using a basic O-shaped terminal 13 as shown in FIG. 11*a*. This terminal will not become disconnected from a bolt or screw threaded into a tapped base, even if the bolt or screw is loose. Of course, however, a poor electrical connection can result from the bolt or screw being loose. A significant disadvantage to the O-shaped terminal 13 is that, whenever securing or removing the O-shaped terminal to and from a corresponding tapped base, the operator is obliged to manually remove the screw or bolt retaining the O-shaped terminal in position. In particular, if the screw or bolt is deeply threaded into the tapped hole of the base or if the thread pitch of the screw or bolt is very small, a significant amount of time is needed to fasten or remove the screw or bolt, thus resulting in an inefficient operation.

In addition to the use of the above-exemplified O-and U-shaped terminals as electrical terminals, such connection devices can also include parts for use in retaining a lid combined with a main body of a bag or a box so that the lid can be held in a closed position.

SUMMARY OF THE INVENTION

The present invention has been proposed to fully solve the problems described above. That is, the object of the invention is to provide a novel connection device that can be easily secured to a base member by merely providing a clearance between the base member and a head unit of a pressing member without having to remove the pressing member from the base member, and which will securely maintain a solid connection between the base member and the connection device even when a pressing force of the pressing member is reduced or substantially removed.

In a first aspect of the present invention, a connection device is provided for use in connecting a first member to a second member. The connection device comprises a first member connection portion, and a second member connection portion integrally formed with the first member connection portion. The first member connection portion includes a base portion connected to the second member connection portion, and first and second arm portions extending in a direction away from the base portion and the second member connection portion. The first and second arm portions are curved outwardly from one another so as to define therebetween a first member receiving hole, and the first and second arm portions have first and second tip portions, respectively, at distal ends thereof, and a first member insertion slit is defined between the tip end portions and extends outwardly from the first member receiving hole. The first and second arm portions are curvilinearly bent so as to be respectively non-planar, and the first member insertion slit is of a width substantially equal to a diameter of the first member receiving hole.

The first member connection portion functions to receive a shaft portion of a first member by allowing the shaft portion to pass through the first member insertion slit, and to subsequently, upon deformation of the first member connection portion into a substantially planar shape, trap the shaft portion in the first member receiving hole in such a manner that the shaft portion cannot pass out of the first member receiving hole through the first member insertion slit.

In one embodiment of the present invention, the first member connection portion of the sheet is formed of a substantially non-elastic material; and in another embodiment of the present invention, the first member connection portion of the sheet member is formed of a substantially elastic material.

The arm portion of the first connecting portion constitutes planar, substantially semi-annular portions, with an initial hole defined therebetween, deformed into curvilinear, non-planar shapes; and the first member insertion slit constitutes an initial slit, having a width substantially smaller than a diameter of the initial hole, expanded to a width substantially equal to the diameter of the first member receiving hole.

In the first embodiment of the present, the second member connection portion comprises a tubular sleeve for receiving an electrical cable; in the second embodiment of the present invention, the second member connection portion comprises a fixing member for fixing the first member connection portion to a second member, such as a lid of a bag.

BRIEF DESCRIPTION OF THE DRAWINGS

FIGS. 11*a*, 11*b* and 11*c* are perspective views of conventional terminal units.

DETAILED DESCRIPTION OF THE PREFERRED EMBODIMENTS

Preferred embodiments of a connection device according to the present invention will now be described with reference to the accompanying drawings.

Figure 1:
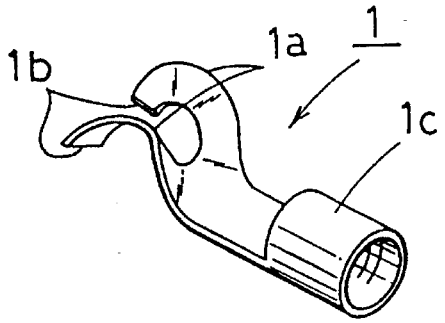
FIGS. 1 is a perspective view of a terminal unit of a first embodiment of a connection device according to the invention.

First Embodiment:

The reference numeral 1 shown in FIG. 1 designates a terminal unit according to the first embodiment of the invention. The terminal unit 1 is formed of metal having plasticity (i.e. which is substantially non-elastic and is thus plastically deformable) such as copper, aluminum, or iron. The reference numeral 1*a* designates a pair of terminal arms defining therebetween a shaft receiving hole having a central axis and having tip parts 1*b* defining therebetween a shaft insertion slit. The reference numeral 1*c* designates a sleeve which secures and connects an electrical cable to the terminal unit by, for example, being crimped onto an end of the electric cable. The reference numeral 2 shown in FIGS. 2 and 3 designates a screw having a head portion 2*a* and a threaded shaft portion 2*b*. The reference numeral 3 designates a base plate having an internally threaded hole 3*a* for engaging the threaded portion 2*b* of the screw 2. When the threaded portion 2*b* of the screw 2 is threaded into the hole 3*a* of the base plate 3, the head portion 2*a* of the screw serves to press the terminal arm 1*a* of the terminal unit 1 downwardly against the base plate 3. The screw 2 and base plate are also referred to together as a first member. The reference character A shown in FIG. 2 designates an electrical cable (also referred to as a second member) connected to the sleeve 1*c*. Thus, the sleeve 1*c* of the terminal unit 1 is also referred to as a second member connection portion, and a remainder of the terminal unit is also referred to as a first member connection portion which includes a substantially planar base portion connected to said second member connection portion and first and second arm portions extending away from the base portion, the base portion lying in a plane perpendicular to the central axis of the shaft receiving hole.

Figure 7:
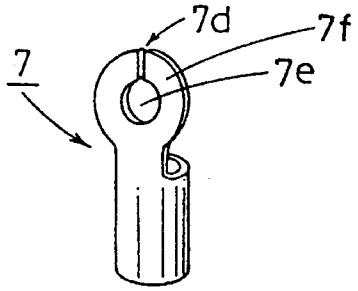
FIG. 7 is a perspective view of a terminal unit element prior to its formation into the terminal unit of the first embodiment of the invention.

A method of forming the terminal unit 1 is described below. FIG. 7 illustrates a terminal unit element 7 having an initial configuration prior to being transformed into the terminal unit 1 shown in FIG. 1. In order to provide the opening (or shaft insertion slit) between the tip parts 1*b* of the terminal arms 1*a* as shown in FIG. 1, force is applied to peripheral portions of a terminal portion 7*f* in order to transform the terminal 7*f* into the curvilinearly-shaped terminal arms 1*a* of the terminal unit (as shown in FIG. 1). In consequence, external peripheral edges on both sides of the terminal arms 1*a* are bulged upwardly above the internal peripheral edges thererof so that the terminal arms (or first and second arm portions) 1*a* are each gradually bent, when viewed in a direction perpendicular central axis of the shaft receiving hole, over substantially an entire length thereof, and so as to have two inflections, and so that the terminal arms 1*a* are symmetric about the central axis. This also results in the clearance (or shaft insertion slit) between the tip parts 1*b* is expanded to such an extent that it is substantially equal to a diameter of a through-hole 7*e* shown in FIG. 7 prior to transformation of the element 7 into the terminal unit 1 (and also substantially equal to a diameter of the through hole, or shaft insertion hole, after transformation of the element 7 into the terminal unit 1). The terminal arms 1*a* jointly form a U-shape or a C-shape as seen from above.

Figure 2A:
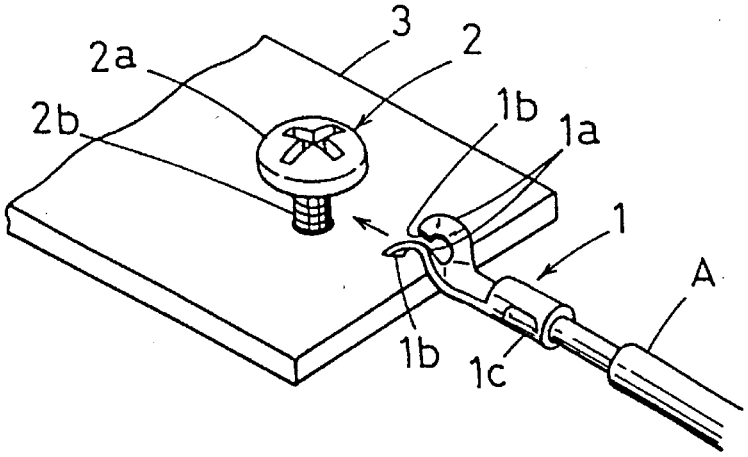
FIGS. 2*a* and 2*b* are perspective views showing unconnected and connected conditions, respectively, of the terminal unit shown in FIG. 1.
Figure 2B:
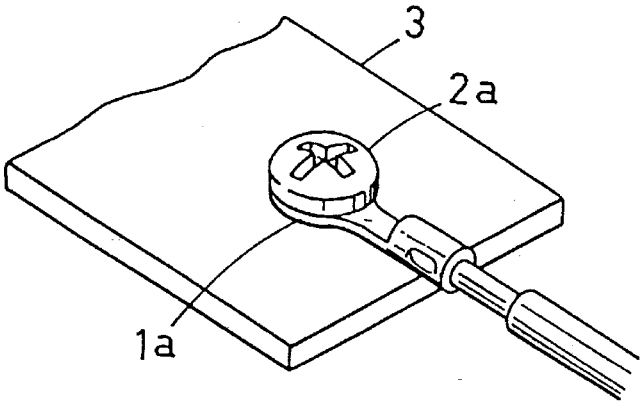
Figure 3A:
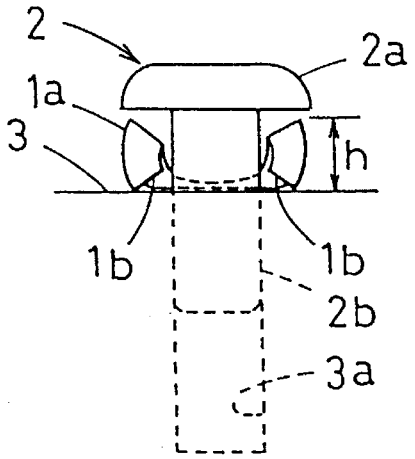
FIGS. 3*a* and 3*b* are cross-sectional views of the terminal unit as shown in FIGS. 2*a* and 2*b*, respectively.
Figure 3B:
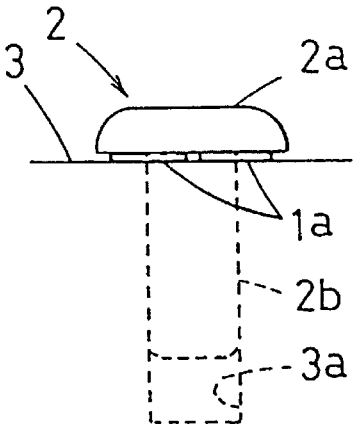

A method of securing the terminal unit 1 to the base plate 3 will now be described with reference to FIGS. 2*a*, 2*b*, 3*a* and 3*b*. FIGS. 2*a* and 3*a* illustrate the terminal unit 1 prior to connection thereof to the base plate 3. FIGS. 2*b* and 3*b* illustrate the terminal unit 1 connected to the base plate 3.

In order to initially position the terminal unit 1 below the head unit 2*a* of the screw 2 (i.e. between the head unit 2*a* and the base plate 3), the screw 2 is screwed partially out (normally in the counterclockwise direction when viewed from above) of the threaded hole 3*a* so that the distance between the head unit 2*a* and the upper surface of the base plate 3 is greater than the height "h" of the terminal arms 1*a* of the terminal unit 1. From this condition, the terminal arms 1*a* are inserted into the clearance formed between the head unit 2*a* and the base plate 3 in the direction shown by an arrow in FIG. 2*a* such that the threaded portion 2*b* of the screw 2 is inserted through the clearance (shaft insertion slit) between the tip parts 1*b* of the terminal unit 1 and into the shaft receiving hole defined between the terminal arms 2*a*, such that the terminal arms 2*a* surround the threaded shaft portion 2*b*. Next, the screw 2 is threaded into the threaded hole 3*a*, such that the head unit 2*a* of the screw 2 presses downwardly against the terminal arms 1*a* having curvilinear configurations on both sides, such that the terminal arms 1*a* become gradually compressed and flattened between the head unit 2*a* and the base plate 3, whereby the tip parts 1*b* are forced inwardly toward one another.

FIGS. 2*b* and 3*b* illustrate the screw 2 fully threaded into the threaded hole 3*a* of the base plate to the extent possible with the flattened terminal arms 1*a* interposed between the head unit 2*a* and the base plate 3. In this state the shapes of the terminal members 1*a* of the terminal unit 1, which are formed of a non-elastic material, have been returned (deformed) back to their original annular shape having a narrow slit between tip ends of the terminal arms such as shown in FIG. 7. Insofar as the terminal unit 1 remains in this condition, the terminal unit 1 functions in a substantially identical manner to a conventional O-shaped terminal unit. In other words, even when the screw 2 is loosened, the terminal unit 1 cannot be removed from the screw 2. Thus, the terminal unit 1 can be easily and quickly connected to the base plate 3 by the screw 2, but will not be disengaged therefrom unintentially even if a tractive force is applied to a cable A connected to the terminal unit 1.

Figure 4A:
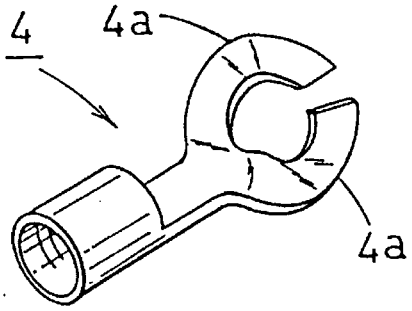
FIG. 4*a* is a perspective view of a terminal unit according to a second embodiment to the invention.
Figure 4B:
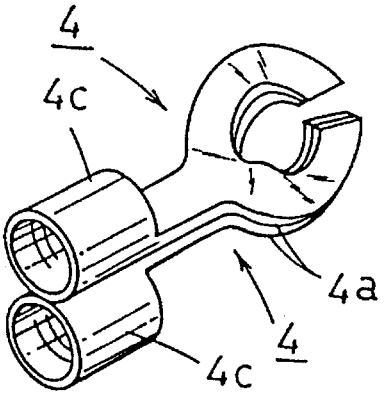
FIG. 4*b* is a perspective view of a terminal unit according to a first modification of the first embodiment of the invention.

In a first modification of the first embodiment, a terminal unit 4 shown in FIG. 4*a* has a configuration different than that of the terminal unit 1. Whereas the terminal arms 1*a* of the terminal unit 1 (shown in FIG. 1) are curvilinearly formed in the same direction (i.e. they are both deformed upwardly), in the FIG. 4*a* arrangement the terminal arms 4*a* of the terminal unit 4 are bent in directions axially opposite from one another (i.e. one arm 4*a* is bent upwardly, and the other 4*a* is bent downwardly). With this structure, even when a pair of terminal units 4 are fixed to a single base plate via a single screw and the pair of terminal units 4 are superposed with the top surface of one in contact with the bottom surface of the other (as shown in FIG. 4*b*), the terminal arms 4*a* of the terminal units 4 can be properly superposed and secured to the base plate without causing deformation of one or both of the sleeves 4*c* toward one another.

Figure 5:
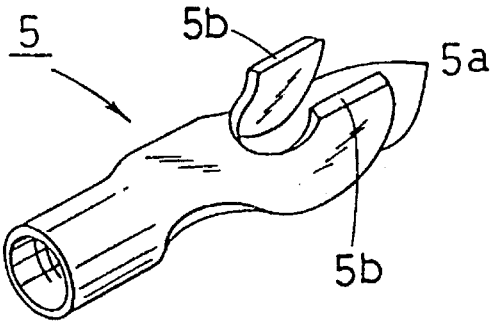
FIG. 5 is a perspective view of a terminal unit according to a second modification of the first embodiment of the invention.
Figure 6:
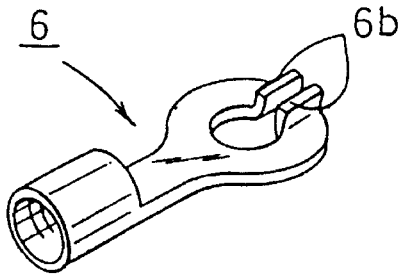
FIG. 6 is a perspective view of a terminal unit according to a third modification of the first embodiment of the invention.

FIG. 5 illustrates another terminal unit 5 having a pair of terminal arms 5*a* which are curvilinearly shaped in such a manner that their tip ends 5*b* extend upwardly and inwardly toward one another to form a "/\"-shaped cross section. Another terminal unit 6 shown in FIG. 6 has a pair of tip parts 6*b* projecting upwardly.

Figure 8:
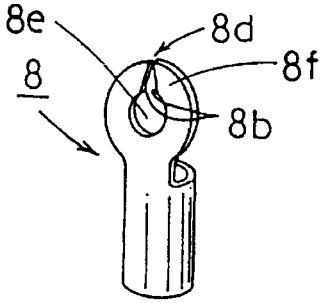
FIGS. 8 and 9 are perspective views of configurations of other terminal unit elements prior to formation thereof into terminal units.
Figure 8A:
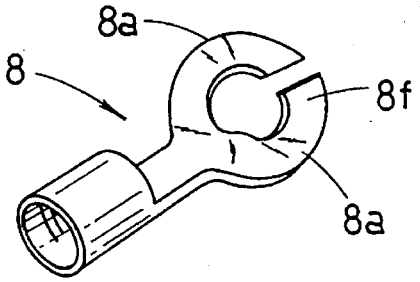
FIGS. 8*a* and 9*a* are perspective view of examples of terminal units resulting from the terminal unit elements of FIGS. 8 and 9, respectively.
Figure 9:
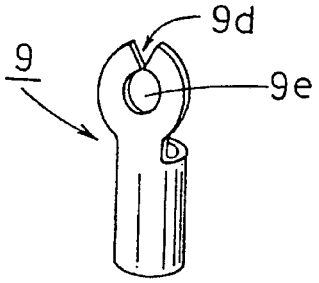

FIGS. 8 and 9 respectively illustrate terminal unit elements 8 and 9, prior to being bent and thus transformed into terminal units, having shapes different than that of the terminal unit element 7 shown in FIG. 7. Whereas the terminal unit element 7 shown in FIG. 7 has a slit 7*d* provided merely by cutting the annular terminal portion 7*f* such that the end faces of the tip ends are parallel to one another, a terminal unit 8 shown in FIG. 8 is provided with a slit 8*d* made by cutting the annular terminal portion 8*f* such that the inner edge width of the slit 8*d* is wider than the outer edge width thereof. With this arrangement, when the arms 8*b* are expanded (deformed to open up the slit), the opposite tip edges of the terminal unit element 8 will become disposed substantially in parallel with each other (as shown in FIG. 8*a*). In consequence, the terminal unit element 8 provides the advantage over the terminal unit element 7 in that the terminal unit 8 can be secured to a screw having a threaded portion 2*b* with a wider diameter without having portions of the clearance between the tip ends wider than necessary to allow passage of the threaded portion 2*b* of the screw 2 pass therethrough.

Slit 9*d* of a terminal unit element 9 has an outer edge width which is wider than its inner edge width. With this arrangement of the terminal unit element 9, the terminal unit which results from deforming the terminal unit element in the manner described above will have a clearance between tip ends of terminal arms which has an outer edge width wider than its inner edge width. Thus, even when the narrowest portion of the slit (i.e. clearance between tip ends) is narrower than the diameter of the threaded portion 2*b* of the screw 2, the terminal unit can be coupled with the screw by being thrust onto the threaded portion 2*b* of the screw 2 before the screw is tightened thereonto. When the terminal unit resulting from the terminal unit element 9 is deformed back to its original planar shape due to compression thereof by the head 2*a* of the screw, the terminal unit will not be unintentionally disengaged from the screw even when a cable A attached thereto is subject to a tractive force since the threaded portion 2*b* of the screw 2 will come into contact with the inner peripheral edge adjacent the slit of the terminal unit.

The diameters of the respective through-holes 7*e*, 8*e*, and 9*e*, are dependent on the external diameter of the threaded portion 2*b* of the screw or bolt 2 with which they will be used.

Figure 9A:
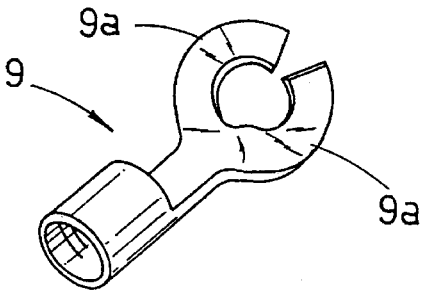

Examples of the terminal units which can be formed from the terminal unit elements 8 and 9 shown of FIGS. 8 and 9 are illustrated in FIGS. 8*a* and 9*a*, respectively.

Figure 10:
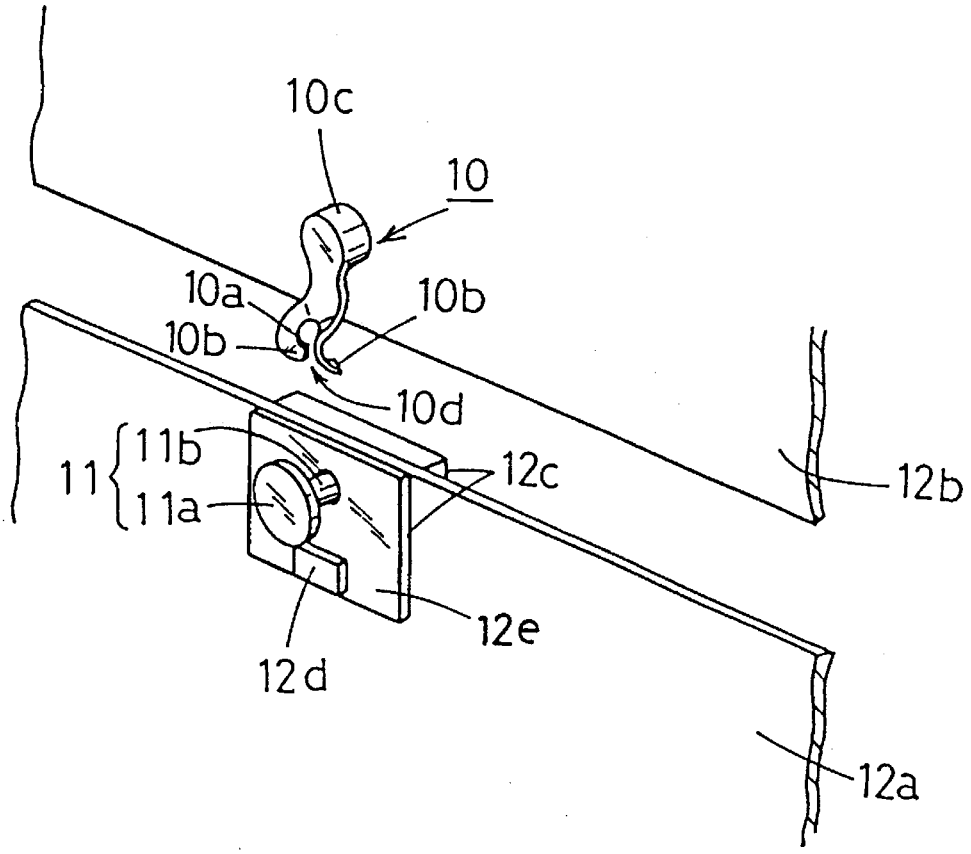
FIG. 10 is a perspective view of a connection device used as a retaining device of a bag according to a second embodiment of the invention.
Figure 10:
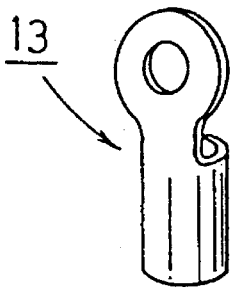
Figure 10:
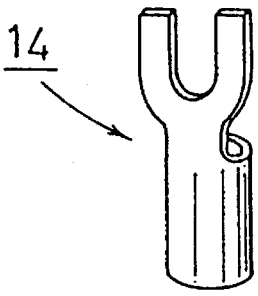
Figure 10:
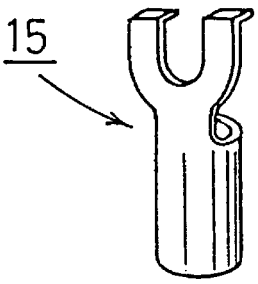

Second Embodiment:

FIG. 10 shows a second embodiment of the present invention, wherein a side structure 12*a* of a bag has a pressing member 11 mounted thereto, and a lid 12*b* of the bag has a retaining member 10 secured thereto via a fixing member 10*c*. The retaining member 10 includes a junction member 10*a* which is made from an elastic material such as spring steel or the like. In a preferred form of this embodiment, the junction member 10*a* is formed into a shape substantially the same as that of the terminal arms 1*a* of the terminal unit 1 shown in FIG. 1. However, the junction member 10*a* can also be formed of shapes such as shown in FIGS. 4*a*, 5, 6, 8*a* and 9*a*. The method of forming the junction member 10*a* is preferably also substantially the same as the method of forming the terminal arms 1*a* (i.e. by starting with a planar element and deforming the planar element into the desired shape), except that it is necessary to use techniques, which are known in the art, effective to deform a planar member formed of an elastic material. As in the first embodiment, the deformation of the planar element is effective to form a slit 10*d* of a sufficient width to allow insertion therethrough of a shaft member 11*b*.

Reference numeral 11 designates a pressing member for exerting a depressing force onto the Junction member 10*a* of the retaining member 10 so as to compress the Junction member 10*a* between a head unit 11*a* of the pressing member 11 and a preferably planar surface 12*e*. The pressing member 11 is arranged on the side structure 12*a* of the bag so as to be aligned with the junction member 10*a* of the retaining member 10 attached to the lid 12*a* of the bag. The pressing member 11 is preferably of a mushroom shape.

When the head unit 11*a* of the pressing member 11 is depressed the shaft member 11*b* projects further inside of a mechanical structure 12*c* so that the pressing member 11 can be securely maintained in its inwardly pressed position by the mechanical structure 12*c*.

In order to secure the lid 12*b* to the side structure 12*a*, with the pressing member 10 in an outwardly projecting position (FIG. 10), the retaining member 10 is engaged with the pressing member 11 such that the shaft member 11*b* is inserted through the slit 10*d* of the retaining member 10. Then the Junction member 10*a* is compressed between the head unit 11*a* and the surface 12*e* by pushing the head unit 11*a* of the pressing member 11 toward its inwardly pressed position. In consequence, the curvilinearly-shaped junction member 10*a* is elastically deformed towards a planar shape, such that the slit 10*d* closes to such an extent that it is narrower than the diameter of the shaft 11*b* of the pressing member 11, thus causing the junction member to attain a nearly annular shape. As a result, even when the retaining member 10 is subjected to a tractive force, the retaining member 10 is prevented from disengaging from the pressing member 11.

In order to disengage the retaining member 10 from the pressing member 11, initially, the shaft member 11*b* is unlocked from the mechanical structure 12*c* by depressing a button 12*d*. Then, since the junction member 10*a* is elastic, the junction member 10*a* returns to its previous shape thereby widening the slit 10*b* and allowing the junction member 10*a* to be disengaged by simply pulling the retaining member 10 upward. It is noted that the engaging and disengaging structure (e.g. 12*c*, 12*d*) is well known in the art and does not, in and of itself, form an inventive part of the present invention. Other similar mechanical structures may be substituted for the structures 12*c*, 12*d* shown in FIG. 10.

Although preferred embodiments of the present invention have been described with reference to the drawing figures, these particular embodiments are merely exemplary. Numerous modifications will be apparent to those of ordinary skill in the art, and the present invention is thus to be limited only by the spirit and scope of the appended claims.

What is claimed is:

1. A connection device for use in connecting a first member to a second member, comprising:

a first member connection portion;

a second member connection portion integrally formed with said first member connection portion;

wherein said first member connection portion includes a substantially planar base portion connected to said second member connection portion, and first and second arm portions extending in a direction away from said base portion and said second member connection portion;

wherein said first and second arm portions are curved outwardly from one another so as to define therebetween a first member receiving hole having a central axis perpendicular to a plane in which lies said substantially planar base portion of said first member connection portion;

wherein said first and second arm portions have first and second tip portions, respectively, at distal ends thereof, and a first member insertion slit is defined between said tip portions and extends outwardly from said first member receiving hole;

wherein said first and second arm portions are curvilinearly bent so as to be respectively non-planar, so as to be deformable into a substantially annular and planar configuration, and so that each of said first and second arm portions, when viewed in a direction perpendicular to said central axis of said first member receiving hole, has only two inflections and is gradually curved over substantially an entire length thereof; and wherein said first member insertion slit is of a width, when viewed in a direction parallel to said central axis of said first member receiving hole, substantially equal to a diameter of said first member receiving hole.

2. A connection device as recited in claim 1, wherein at least said first member connection portion is formed of a substantially non-elastic material.

3. A connection device as recited in claim 1, wherein at least said first member connection portion is formed of a substantially elastic material.

4. A connection device as recited in claim 1, wherein said arm portions constitute substantially semi-annular planar portions, having an initial hole defined therebetween, deformed into curvilinear, non-planar shapes; and said first member insertion slit constitutes an initial slit, having a width substantially smaller than a diameter of said initial hole, expanded to a width substantially equal to the diameter of said first member receiving hole.

5. A connection device as recited in claim 1, wherein said second member connection portion comprises a tubular sleeve for receiving an electrical cable.

6. A connection device as recited in claim 1, wherein each of said first and second arm portions is curvilinearly bent, when viewed in a direction perpendicular to said central axis of said first member receiving hole, such that said first and second arm portions are symmetric about said central axis.

7. A connection device as recited in claim 1, wherein each of said first and second arm portions is curvilinearly bent, when viewed in a direction perpendicular to said central axis of said first member receiving hole, such that said first and second arm portions are bent in opposite axial directions respectively above and below the plane in which lies said substantially planar base portion of said first member connection portion.

8. A connection device as recited in claim 1, wherein said first member connection portion comprises a means for receiving a shaft portion of a first member by allowing the shaft portion to pass through said first member insertion slit, and for subsequently, upon deformation of said first member connection portion into a substantially planar shape, trapping the shaft portion in said first member receiving hole in such a manner that the shaft portion cannot pass out of said first member receiving hole through said first member insertion slit.

9. A connection device as recited in claim 8, wherein at least said first member connection portion is formed of a substantially non-elastic material.

10. A connection device as recited in claim 8, wherein at least said first member connection portion is formed of a substantially elastic material.

11. A connection device as recited in claim 8, wherein said arm portions constitute substantially semi-annular planar portions, having an initial hole defined therebetween, deformed into curvilinear, non-planar shapes; and said first member insertion slit constitutes an initial slit, having a width substantially smaller than a diameter of said initial hole, expanded to a width substantially equal to the diameter of said first member receiving hole.

12. A connection device for use in connecting a first member to a second member, comprising:

a non-planar first member connection portion;

a second member connection portion integrally formed with said first member connection portion;

wherein said first member connection portion includes a substantially planar base portion connected to said second member connection portion, and first and second arm portions extending in a direction away from said base portion and said second member connection portion;

wherein said first and second arm portions are curved outwardly from one another so as to define therebetween a first member receiving hole having a central axis perpendicular to a plane in which lies said substantially planar base portion of said first member connection portion;

wherein said first and second arm portions have first and second tip portions, respectively, at distal ends thereof, and a first member insertion slit is defined between said tip portions and extends outwardly from said first member receiving hole;

wherein said first member connection portion comprises a means for receiving a shaft portion of a first member by allowing the shaft portion to pass through said first member insertion slit while the shaft portion is oriented parallel to said central axis of said first member receiving hole, and for subsequently, upon deformation of said first member connection portion into a substantially planar shape, trapping the shaft portion in said first member receiving hole in such a manner that the shaft portion cannot pass out of said first member receiving hole through said first member insertion slit; and wherein said first and second arm portion are curvilinearly bent so as to be respectively non-planar, so as to be deformed into a substantially planar and annular configuration, and so that each of said first and second arm portions, when viewed in a direction perpendicular to said central axis of said first member receiving hole, has only two inflections and is gradually curved over substantially an entire length thereof receiving hole through said first member insertion slit.

13. A connection device as recited in claim 12, wherein at least said first member connection portion is formed of a substantially non-elastic material.

14. A connection device as recited in claim 12, wherein at least said first member connection portion is formed of a substantially elastic material.

15. A connection device as recited in claim 12, wherein said arm portions constitute substantially semi-annular planar portions, having an initial hole defined therebetween, deformed into curvilinear, non-planar shapes; and said first member insertion slit constitutes an initial slit, having a width substantially smaller than a diameter of said initial hole, expanded to a width substantially equal to the diameter of said first member receiving hole.

16. A connection device as recited in claim 12, wherein said second member connection portion comprises a tubular sleeve for receiving an electrical cable.

17. A connection device as recited in claim 12, wherein each of said first and second arm portions is curvilinearly bent, when viewed in a direction perpendicular to said central axis of said first member receiving hole, such that said first and second arm portions are symmetric about said central axis.

18. A connection device as recited in claim 12, wherein each of said first and second arm portions is curvilinearly bent, when viewed in a direction perpendicular to said central axis of said first member receiving hole, such that said first and second arm portions are bent in opposite axial directions respectively above and below the plane in which lies said substantially planar base portion of said first member connection portion.

19. A connection device comprising:

a first member including a base plate with a retraction hole therein, a shaft portion extending from and partially retractable into said retraction hole, and a head portion secured onto an end of said shaft portion;

a first member connection portion for selective connection to said first member;

a second member connection portion integrally formed with said first member connection portion;

wherein said first member connection portion includes a substantially planar base portion connected to said second member connection portion, and first and second arm portions extending in a direction away from said base portion and said second member connection portion;

wherein said first and second arm portions are curved outwardly from one another so as to define therebetween a first member receiving hole having a central axis perpendicular to a plane in which lies said substantially planar base portion of said first member connection portion;

wherein said first and second arm portions have first and second tip portions, respectively, at distal ends thereof, and a first member insertion slit is defined between said tip portions and extends outwardly from said first member receiving hole;

wherein said first and second arm portions are curvilinearly bent so as to be respectively non-planar, so as to be deformable into a substantially planar and annular configuration, and so that each of said first and second arm portions, when viewed in a direction perpendicular to said central axis of said first member receiving hole, has only two inflections and is gradually curved over substantially an entire length thereof; and wherein said first member insertion slit is of a width, when viewed in a direction parallel to said central axis of said first member receiving hole, substantially equal to a diameter of said first member receiving hole and at least as large as a diameter of said shaft portion of said first member.

20. A connection device as recited in claim 19, wherein at least said first member connection portion is formed of a substantially non-elastic material.

21. A connection device as recited in claim 19, wherein at least said first member connection portion is formed of a substantially elastic material.

22. A connection device as recited in claim 19, wherein said arm portions constitute substantially semi-annular planar portions, having an initial hole defined therebetween, deformed into curvilinear, non-planar shapes; and said first member insertion slit constitutes an initial slit, having a width substantially smaller than a diameter of said initial hole, expanded to a width substantially equal to the diameter of said first member receiving hole.

23. A connection device as recited in claim 19, wherein said second member connection portion comprises a tubular sleeve for receiving an electrical cable.

24. A connection device as recited in claim 19, wherein said first member connection portion comprises a means for receiving said shaft portion of said first member by allowing said shaft portion to pass through said first member insertion slit, and for subsequently, upon deformation of said first member connection portion into a substantially planar shape, trapping said shaft portion in said first member receiving hole in such a manner that said shaft portion cannot pass out of said first member receiving hole through said first member insertion slit.

25. A connection device as recited in claim 19, wherein each of said first and second arm portions is curvilinearly bent, when viewed in a direction perpendicular to said central axis of said first member receiving hole, such that said first and second arm portions are symmetric about said central axis.

26. A connection device as recited in claim 19, wherein each of said first and second arm portions is curvilinearly bent, when viewed in a direction perpendicular to said central axis of said first member receiving hole, such that said first and second arm portions are bent in opposite axial directions respectively above and below the plane in which lies said substantially planar base portion of said first member connection portion.

* * * * *